US010580599B1

(12) United States Patent
Wang et al.

(10) Patent No.: US 10,580,599 B1
(45) Date of Patent: Mar. 3, 2020

(54) VACUUM CIRCUIT INTERRUPTER WITH ACTUATION HAVING ACTIVE DAMPING

(71) Applicant: Eaton Intelligent Power Limited, Dublin (IE)

(72) Inventors: Hongbin Wang, Novi, MI (US); Steven Zhenghong Chen, Moon Township, PA (US); Li Yu, Bridgeville, PA (US); Andrew A. Rockhill, Waukesha, WI (US); Robert W. Mueller, Aliquippa, PA (US); David R. Rohn, Venetia, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/106,772

(22) Filed: Aug. 21, 2018

(51) Int. Cl.

| | |
|---|---|
| ***H01H 33/666*** | (2006.01) |
| ***H01H 33/664*** | (2006.01) |
| ***H01F 7/02*** | (2006.01) |
| ***H01F 7/08*** | (2006.01) |

(52) U.S. Cl.
CPC ..... *H01H 33/666* (2013.01); *H01F 7/0231* (2013.01); *H01F 7/081* (2013.01); *H01H 33/6644* (2013.01)

(58) Field of Classification Search
CPC .. H01H 1/50; H01H 3/60; H01H 3/28; H01H 33/666; H01H 33/6662; H01H 33/6644; H01F 7/0231; H01F 7/081
USPC ..... 218/140, 141, 139, 134; 200/16 B
See application file for complete search history.

(56) References Cited

U.S. PATENT DOCUMENTS

| | | | | |
|---|---|---|---|---|
| 4,064,383 | A | 12/1977 | Barkan | |
| 5,543,766 | A | 8/1996 | Bagalini | |
| 5,793,008 | A | 8/1998 | Mayo et al. | |
| 5,912,604 | A * | 6/1999 | Harvey | H01H 33/6662 218/138 |
| 6,020,567 | A * | 2/2000 | Ishikawa | H01H 3/28 218/120 |
| 6,331,687 | B1 * | 12/2001 | Dunk | H01H 11/0062 218/140 |
| 6,580,345 | B2 * | 6/2003 | Akita | H01H 33/285 218/141 |
| 6,819,209 | B2 | 11/2004 | Yajima et al. | |
| 7,739,058 | B2 * | 6/2010 | Maruyama | H01F 7/1844 702/115 |
| 8,912,871 | B2 * | 12/2014 | Lauraire | H01H 3/28 218/120 |

(Continued)

OTHER PUBLICATIONS

Vilchis-Rodriguez D.S. et al., Double-sided Thomson coil based actuator: Finite element design and performance analysis, ResearchGate, Conference Paper, Jan. 2016.

*Primary Examiner* — William A Bolton
(74) *Attorney, Agent, or Firm* — Fox Rothschild LLP

(57) ABSTRACT

A circuit interrupter system includes a vacuum circuit interrupter having a vacuum chamber that contains a fixed contact and a moveable contact. A non-conductive rod extends from the moveable contact. One or more Thomson coils are wound around the rod, and one or more armatures are connected to the rod. When a driver energizes one of the Thomson coils, a corresponding armature will be repelled from that Thomson coil and move the rod to open or close the contacts of the vacuum circuit interrupter. The system also may include a damper that provides an active damping force rod when the rod is moved to open and/or close the vacuum circuit interrupter.

25 Claims, 4 Drawing Sheets

(56) References Cited

U.S. PATENT DOCUMENTS

| | | | | |
|---|---|---|---|---|
| 9,006,600 | B2 | 4/2015 | Leusenkamp et al. | |
| 9,053,879 | B2 * | 6/2015 | Lammers | H01H 36/00 |
| 9,508,514 | B2 * | 11/2016 | Ohda | H01H 33/38 |
| 9,842,713 | B2 | 12/2017 | Yu et al. | |
| 9,947,448 | B2 | 4/2018 | Kohlhafer | |
| 2015/0167770 | A1 * | 6/2015 | Trangbaek | F16F 6/005 280/5.508 |
| 2015/0235784 | A1 * | 8/2015 | Karlstrom | H01H 3/60 200/48 R |
| 2015/0371748 | A1 * | 12/2015 | Kim | H01F 7/18 361/190 |
| 2017/0154747 | A1 | 6/2017 | Bissal et al. | |

* cited by examiner

VACUUM CIRCUIT INTERRUPTER WITH ACTUATION HAVING ACTIVE DAMPING

BACKGROUND

Circuit breakers, sometimes referred to as circuit interrupters, include electrical contacts that connect to each other to pass current from a source to a load. The contacts may be separated in order to interrupt the delivery of current, either in response to a command or to protect electrical systems from electrical fault conditions such as current overloads, short circuits, and low level voltage conditions.

Opening the contacts in a circuit breaker can create an arc. To avoid this result, circuit breakers may use an insulated gas, oil, or a vacuum chamber in order to extinguish the current and the arc. Vacuum circuit interrupters include a separable pair of contacts positioned within an insulated and hermetically sealed vacuum chamber. The chamber is contained within a housing. Typically, one of the contacts is moveable and the other is fixed with respect to the housing, although in some vacuum interrupters both contacts may be moveable.

In certain circuits, such as medium voltage direct current (DC) circuits, it is desirable to have a vacuum circuit interrupter in which the contacts move with a fast opening speed. Some ultra-fast switching mechanisms can have opening speeds of as much as 5 meters per second (m/s), as compared to traditional vacuum circuit interrupters in which the opening speed is 0.5 to 1 m/s. However, fast opening speeds can create issues. Because the contacts' velocity of travel must remain high all the way through the contacts' end-of-travel position, contacts can slam against other parts, creating wear, bounce and other undesirable effects.

To mitigate this, in the prior art vacuum circuit interrupters have used dampers in the form of springs, rubber, and other elastic structures that serve as an energy absorber at the end of travel. However, when such materials are repeatedly compressed, their durability can deteriorate. In addition, when the movable contact hits the fixed contact it can bounce back, creating vibration and reducing the ability to precisely control movement of the moveable contact and thus the current interruption performance This document describes methods and systems that are intended to address some or all of the problems described above.

SUMMARY

In various embodiments, a circuit interrupter system includes a vacuum circuit interrupter that has a fixed contact and a moveable contact, both of which are contained within a vacuum chamber. A non-conductive rod is connected to the moveable contact and extends from the vacuum chamber. An actuator is connected to the non-conductive rod. The actuator can selectively move the non-conductive rod in a first direction that will drive the moveable contact away from the fixed contact, and in a second direction that will drive the moveable contact away from the fixed contact. A damper that provides an active damping force to the non-conductive rod when the non-conductive rod is moved in the first direction, the second direction, or both the first direction and the second direction. The damper includes a solenoid and a plunger.

Optionally, the actuator may include a Thomson coil that is wound around the non-conductive rod, an armature that is connected to the non-conductive rod, and a driver that is configured to energize the Thomson coil so that when the Thomson coil is energized the armature will be repelled from the Thomson coil and move the non-conductive rod in the second direction and open the vacuum circuit interrupter.

Optionally, the actuator may include a first Thomson coil that is wound around the non-conductive rod, a second Thomson coil that is wound around the non-conductive rod, an armature that is connected to the non-conductive rod and positioned between the first Thomson coil and the second Thomson coil, and a driver. The driver may be configured to selectively energize the first Thomson coil and the second Thomson coil. When the first Thomson coil is energized, the armature may be repelled from the first Thomson coil, and the armature will move the non-conductive rod in the first direction. When the second Thomson coil is energized, the armature may be repelled from the second Thomson coil, and the armature will move the non-conductive rod in the second direction.

Optionally, the actuator may include a first Thomson coil that is wound around the non-conductive rod, a second Thomson coil that is wound around the non-conductive rod, a first armature that is connected to the non-conductive rod and positioned between the first Thomson coil and the vacuum circuit interrupter, a second armature that is connected to the non-conductive rod and positioned so that the second Thomson coil is between the vacuum circuit interrupter and the second armature, and a driver. The driver may be configured to selectively energize the first Thomson coil and the second Thomson coil. When the first Thomson coil is energized, the first armature may be repelled from the first Thomson coil, and the first armature may thus move the non-conductive rod to close the vacuum circuit interrupter. When the second Thomson coil is energized, the second armature may be repelled from the second Thomson coil, and the second armature may move the non-conductive rod in the second direction to open the vacuum circuit interrupter.

Optionally, the plunger may include a permanent magnet. Also optionally, the system may include a solenoid actuator that is electrically connected to the solenoid and that is configured to vary damping force of the damper by varying a level of voltage or current provided to the solenoid.

In various additional embodiments, a circuit interrupter system includes a vacuum circuit interrupter having a fixed contact and a moveable contact contained within a vacuum chamber. A non-conductive rod is connected to the moveable contact and extends from the vacuum chamber. An actuator is connected to the non-conductive rod. The actuator may include a first Thomson coil that is wound around the non-conductive rod, a first armature that is connected to the non-conductive rod, and a driver that is configured to energize the first Thomson coil so that when the first Thomson coil is energized the armature will be repelled from the first Thomson coil and move the non-conductive rod to open the vacuum circuit interrupter. The system also may include a damper that includes a solenoid and a permanent magnet that is configured to provide an active damping force to the non-conductive rod when the non-conductive rod is moved to open the vacuum circuit interrupter.

Optionally, the actuator may include a second Thomson coil that is wound around the non-conductive rod, and the armature may be positioned between the first Thomson coil and the second Thomson coil. If so, the driver may be configured to selectively energize the first Thomson coil and the second Thomson coil so that when the second Thomson coil is energized, the armature will be repelled from the second Thomson coil, and the armature will move the non-conductive rod to close the vacuum circuit interrupter. Optionally, the damper also may be configured to provide an active damping force to the non-conductive rod when the non-conductive rod is moved to close the vacuum circuit interrupter.

Optionally, the first armature may be positioned between the first Thomson coil and the vacuum circuit interrupter, and the actuator also may include a second armature that is connected to the non-conductive rod, and a second Thomson coil that is positioned between the second armature and the first Thomson coil. The driver also may be configured to selectively energize the first Thomson coil and the second Thomson coil so that when the second Thomson coil is energized, the second armature will be repelled from the second Thomson coil, and the second armature will move the non-conductive rod to close the vacuum circuit interrupter.

Optionally, the circuit interrupter system may include a solenoid actuator that is electrically connected to the solenoid and that is configured to vary damping force of the damper by varying a level of voltage or current provided to the solenoid.

In any of the embodiments described above, the damper may be connected to the non-conductive rod. The actuator may be positioned between the damper and the vacuum circuit interrupter. Alternatively, the damper may be positioned between the actuator and the vacuum circuit interrupter. Alternatively, the damper may be connected to an additional non-conductive rod that is connected to the fixed contact, and that extends from the vacuum chamber.

In various additional embodiments, a method of operating a vacuum circuit interrupter may include actuating an actuator to operate a vacuum circuit interrupter that comprises a fixed contact and a moveable contact contained within a vacuum chamber. The actuator may include a first Thomson coil that is wound around the non-conductive rod, a first armature that is connected to the non-conductive rod, and a driver that is configured to energize the first Thomson coil. The actuator may be connected to a non-conductive rod that is connected to the moveable contact and that extends from the vacuum chamber. The actuating may include, by the driver, energizing the first Thomson coil so that when the first Thomson coil is energized the first armature will be repelled from the first Thomson coil and move the non-conductive rod to open the vacuum circuit interrupter. The method also may include causing a damper that is attached to the non-conductive rod to apply an active damping force to the non-conductive rod when the non-conductive rod is moved.

Optionally, the actuator also may include a second Thomson coil that is wound around the non-conductive rod, and the first armature may be positioned between the first and second Thomson coils. If so, then the actuating also may include, by the driver, energizing the second Thomson coil so that when the second Thomson coil is energized the first armature will be repelled from the second Thomson coil and move the non-conductive rod to close the vacuum circuit interrupter. Alternatively, the actuator may include both a second Thomson coil that is wound around the non-conductive rod and a second armature that is connected to the non-conductive rod, and the two Thomson coils may be positioned between the two armatures. If so, then the actuating may include, by the driver, energizing the second Thomson coil so that when the second Thomson coil is energized the second armature will be repelled from the second Thomson coil and move the non-conductive rod to open the vacuum circuit interrupter.

DETAILED DESCRIPTION

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a direction in which those components are so oriented with respect to each other. The relative orientations of the components may be reversed, or the components may be on the same plane, if the orientation of the structure that contains the components is changed. The claims are intended to include all orientations of a device containing such components.

In this document, values that are described as being approximate, or that are characterized as being "approximately" a value, are intended to include a range of plus or minus 10 percent around the value.

Figure 1:
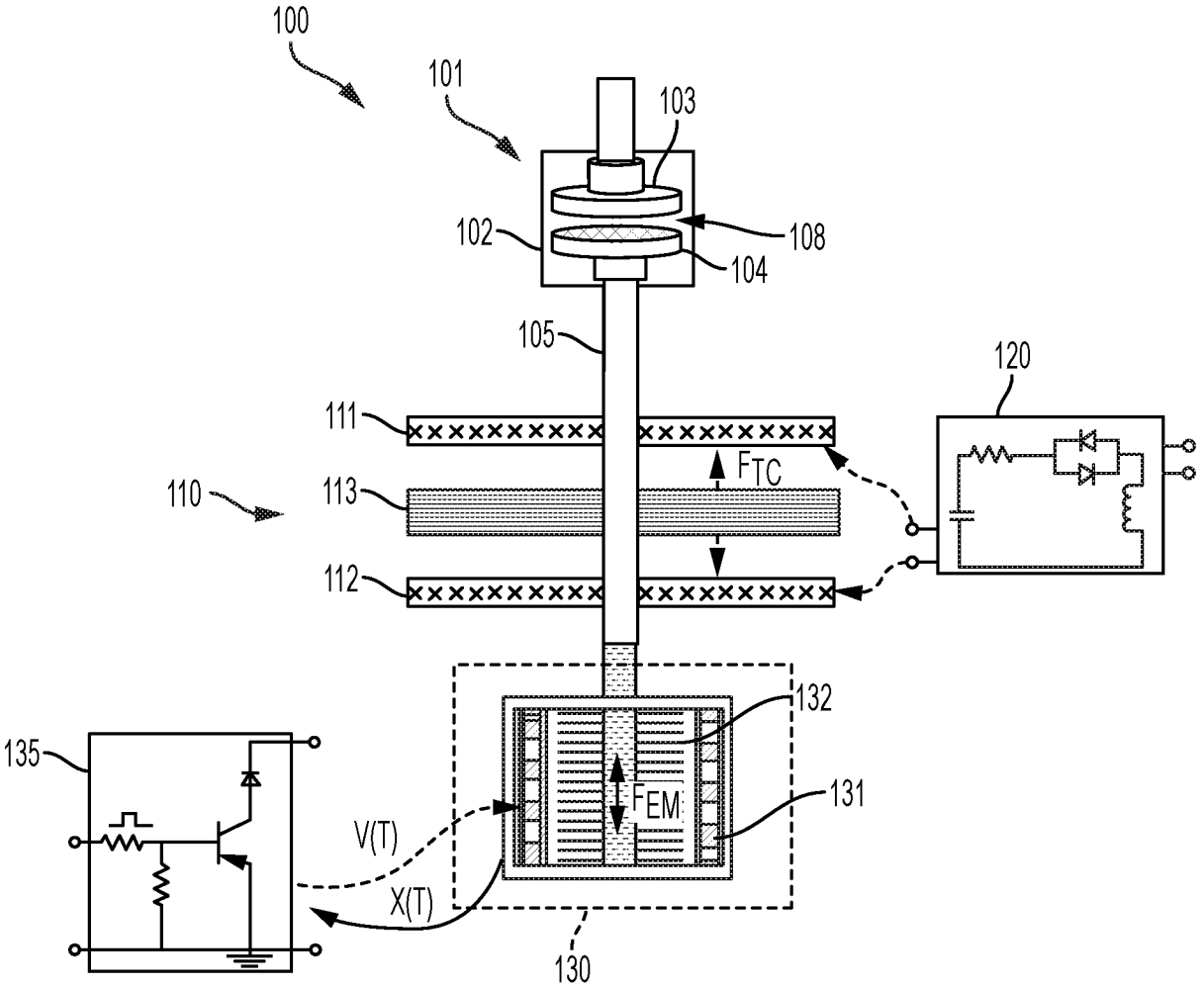
FIG. 1 illustrates a first embodiment of a vacuum circuit interrupter and an associated actuator and damping device.

FIG. 1 illustrates example components of an embodiment of a vacuum circuit interrupter and actuator system 100 that includes a vacuum circuit interrupter 101 that includes a vacuum chamber 102. A fixed contact 103 and a moveable contact 104 extend into top and bottom portions of the vacuum chamber 102. The fixed and moveable contacts 103, 104 may be formed of copper, a copper alloy or another suitable conductive material. The fixed and moveable contacts 103, 104 may be connected to pass current, or they may be separated to form a gap 108 that interrupts and/or prevents current from passing between the contacts.

In FIG. 1, a non-conductive rod 105 extends from the moveable contact 104 to an actuator 110 that, when actuated by a driver 120, causes the moveable contact 104 to move toward or away from the fixed contact 103. The actuator 110 shown is a Thomson coil actuator that includes a first Thomson coil 111, a second Thomson coil 112, and a conductive plate 113 positioned between the first and second Thomson coils to serve as an armature. Each Thomson coil 111, 112 is a relatively flat spiral coil that is wound in either a clockwise or counterclockwise direction around the non-conductive rod 105. The conductive plate 113 may be in the form of a disc or other structure that is connected to the non-conductive rod 105 to serve as an armature that may drive the rod in one direction or the other. The non-conductive rod 105 passes through the centers of each Thomson coil 111, 112. Each Thomson coil 111, 112 is electrically connected to the driver 120.

In some embodiments, the driver 120 may selectively energize either the first Thomson coil 111 or the second Thomson coil 112. When the driver 120 energizes the first Thomson coil 111, the first Thomson coil 111 will generate a magnetic force that will repel the conductive plate 113 away from the first Thomson coil 111 and toward the second Thomson coil 112. This causes the rod 105 to move in a downward direction in the orientation shown, which moves the moveable contact 104 away from the fixed contact 103 and opens the circuit. In some embodiments, such as those in which a fast closing operation is desired, when the driver 120 energizes the second Thomson coil 112, the second Thomson coil 112 will generate a magnetic force that will repel the conductive plate 113 away from the second Thomson coil 112 and toward the first Thomson coil 111. This causes the rod 105 to move in an upward direction in the orientation shown, which moves the moveable contact 104 toward the fixed contact 103 and closes the circuit.

Figure 2:
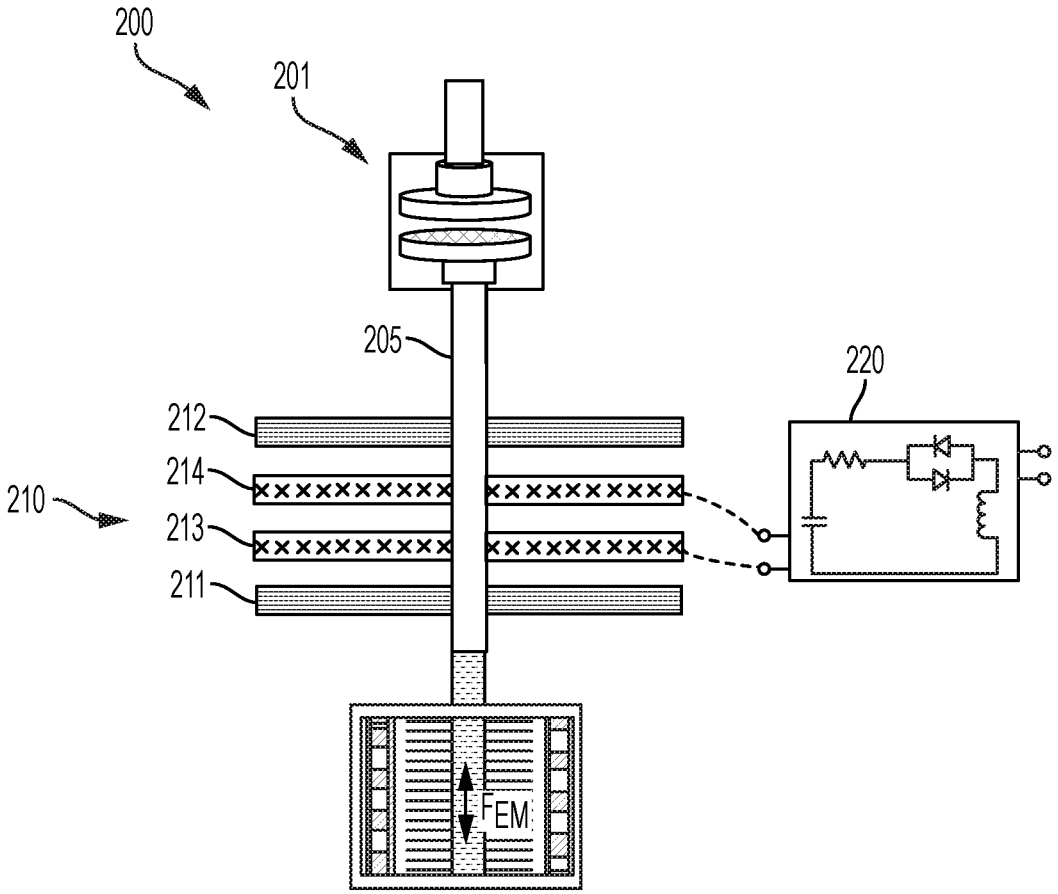
FIG. 2 illustrates an alternative positioning of Thomson coils and conductive plates in a vacuum circuit interrupter and an associated actuator and damping device.

Alternatively as shown in FIG. 2, in an embodiment a vacuum circuit interrupter and actuator system 200 also includes a vacuum circuit interrupter 201, a rod 205, and an actuator 210. However, in this embodiment the actuator 210 includes a pair of Thomson coils 213, 214 positioned between two conductive plates 211, 212. A first one of the plates 211 will be relatively further the vacuum circuit interrupter 201, and the second plate 212 will be relatively closer the vacuum circuit interrupter 201. The driver 220 may selectively energize either of the Thomson coils 213, 214. When the driver 220 energizes the first Thomson coil 213, the first plate 211 (i.e., the one that is positioned relatively further from the vacuum circuit interrupter 201 will be repelled from the first Thomson coil 213, causing the rod to move in the downward direction (based on the orientation shown), which will open the vacuum circuit interrupter. When, the driver 220 energizes the second Thomson coil 214, it will repel the second conductive plate 212 from the Thomson coil pair, which cases the rod 205 to close the vacuum circuit interrupter 201.

In FIG. 1 the non-conductive rod 105 also extends from the moveable contact 104 to an electromagnetic damping device 130 (sometimes referred to below as a damper) that generates an electromagnetic force to provide active damping as the actuator 110 moves the rod 105 in either the first or the second direction. The damping device 130 also can serve as a magnetic holding device to hold the rod 105 in place in either the open or closed position. The damping device 130 includes a solenoid 131 that surrounds a plunger 132. The plunger is in this example a permanent magnet (PM). The plunger 132 is attached to the rod 105 and serves to hold the rod 105 (and its connected moveable contact 104) in either the open position or the closed position. A solenoid driver 135 can vary the voltage and/or current delivered to the solenoid, which provides a controllable active damping force to the rod 105. For example, the system may include a travel transducer or another positional sensor that detects a position of the rod 105. The solenoid driver 130 may receive the output of the positional sensor and generate a waveform by pulse width modulation (PWM) that will cause the current (or voltage) delivered to the solenoid 131 to increase as the position of the rod 105 moves toward the end of its path of travel in either direction. Alternatively, the solenoid driver 135 may receive a signal from the actuator's driver 120, and the solenoid driver 135 may cause the cause the current (or voltage) delivered to the solenoid 131 to increase over a time period that the solenoid driver is programmed to associate with the time that it will take for the moveable contact to complete its path of travel. Either way, the solenoid driver 130 may cause the damper to act as a throttle against movement of the rod 105 as the rod approaches its end-of-travel position.

In some embodiments, the dampening force may vary as a function of the force applied to by the actuator, as well as the force applied by friction. This may be illustrated by the equation:

$$m\frac{d^2x}{dt^2} = F_{TC}(t) - F_{EM}(t) - F_{FRIC}(t)$$

in which $$m\frac{d^2x}{dt^2}$$

is the damping force, t=time, $F_{TC}$=the force applied by the actuator (such as the example Thomson coil), $F_{EM}$=the active control force applied by the electromagnetic damper to provide damping to the rod, and $F_{FRIC}$=the force of friction in the system.

Figure 3:
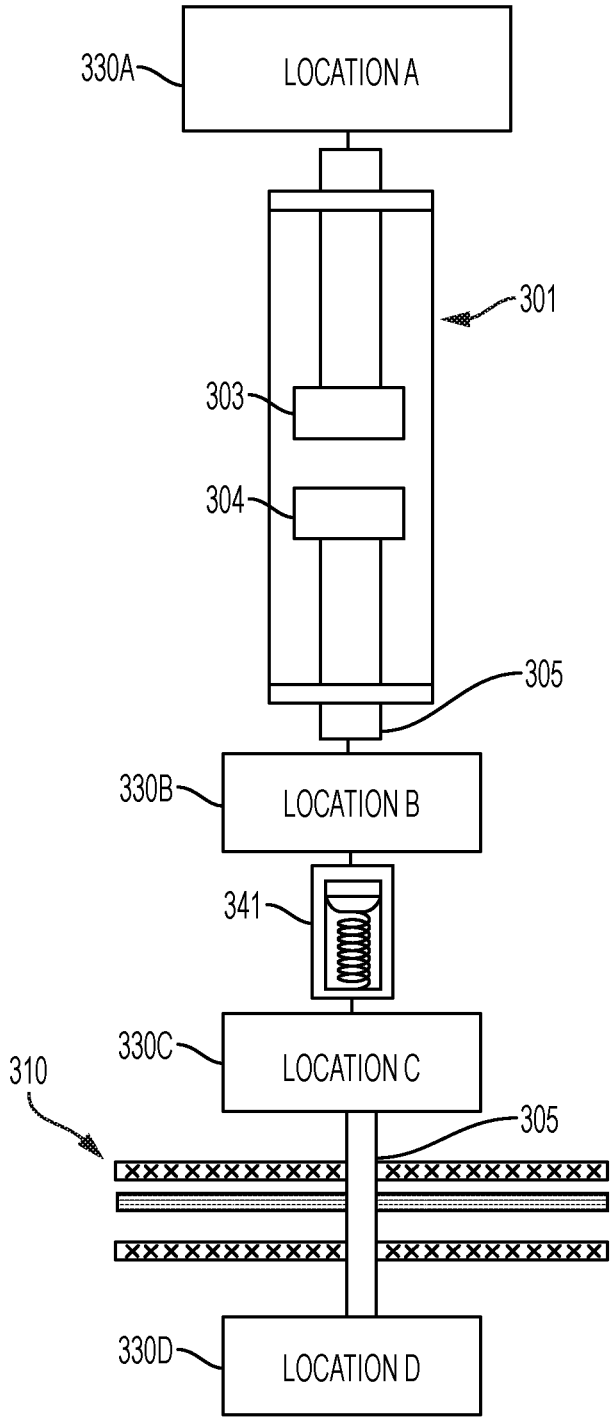
FIG. 3 illustrates various locations in which a damping device may be positioned with respect to other components of the system.

In FIG. 1, the damping device 130 is positioned at the end of the rod 105 that drives the moveable contact 104, and the actuator 110 is positioned between the damping device 130 and the vacuum circuit interrupter 101. However, the damping device may be positioned in other locations. FIG. 3 shows examples of such locations. In FIG. 3, the vacuum circuit interrupter 301 again includes a stationary (fixed) contact 303 and a moveable contact 304. The moveable contact 304 is connected to a non-conductive rod 305, which is connected to an actuator 310 that selectively drives the rod (and the moveable contact) toward or away from the stationary contact 305. In this embodiment, a contact spring 341 is connected to the rod 305 between the actuator 310 and the vacuum circuit interrupter 301. The contact spring 341 provides additional damping force, but is optional and not required in all embodiments.

In FIG. 3, location D is similar to the position shown FIG. 1 in that the damper 330D is positioned at, near or toward the end of the rod 305, and the actuator 310 is located between the damper 330D and the vacuum circuit interrupter.

Alternatively, the damper 330C or 330B may be positioned between actuator 310 and the vacuum circuit interrupter 301. In this embodiment, a contact spring 341 may be connected to the rod 305 between the actuator 310 and the vacuum circuit interrupter 301. The contact spring 341 provides additional damping force, but is optional and not required in all embodiments. If so, the damper 330B may be positioned in location B between the contact spring 341 and the vacuum circuit interrupter 301, or the damper 330C may be positioned in location C between the contact spring 341 and the actuator 310.

As an additional alternative, the damper 330A may be connected to the fixed contact 303, between the fixed electrodes of the vacuum interrupter 301 and ground. In this position the damper 330A would provide damping forces but the overall system, but it would not hold the rod 305 in any particular position.

In the various options shown in FIG. 3, when the damper 330A or 330B is positioned in location A or B the arrangement provides damping of the contact gap (i.e., damping against closure of the contacts). When the damper 330C or 330D is positioned in location C or D the arrangement provides damping of the end of travel (i.e., damping against opening of the contacts). Locations B and C can provide some damping in both directions of travel. In some embodiments, two or more dampers may be used in any or all of the locations shown in FIG. 3.

Figure 4:
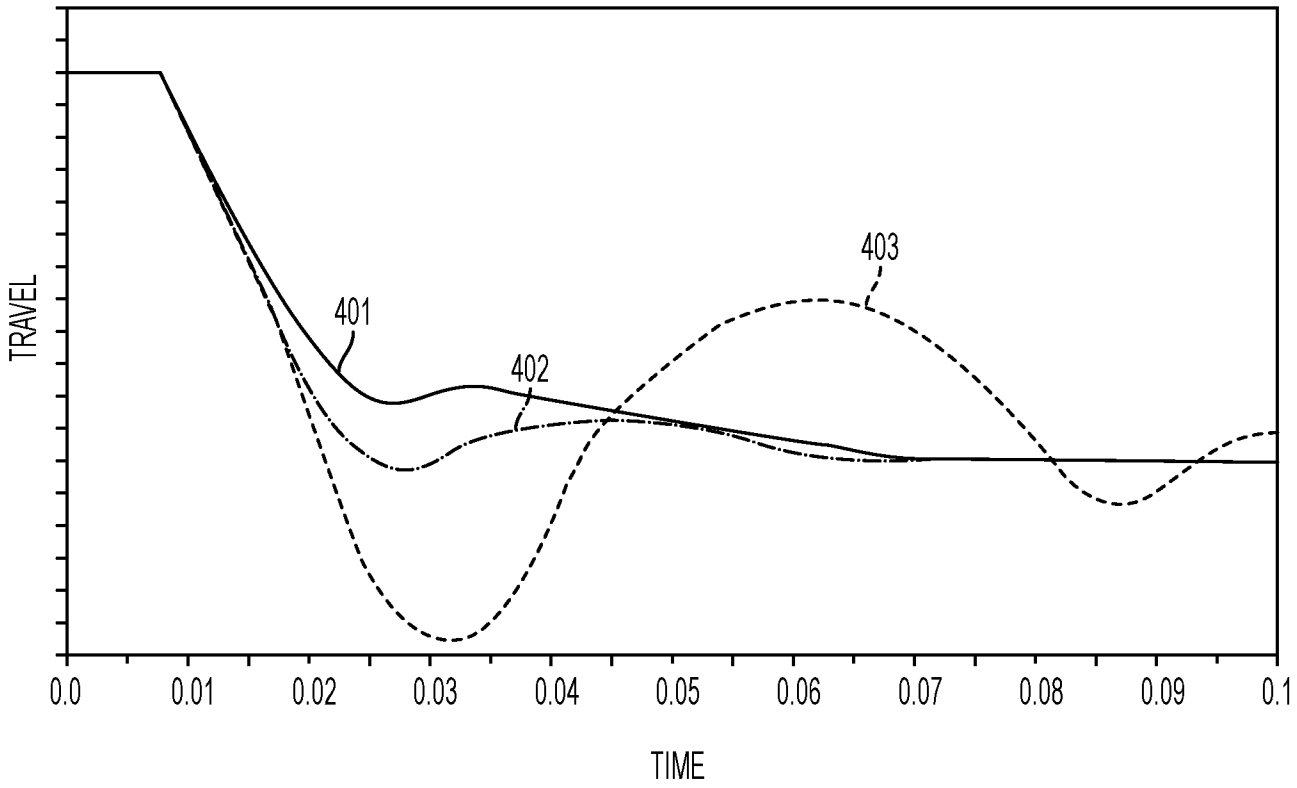
FIG. 4 illustrates how an active damping device such as that described in this document can improve operation of the vacuum circuit interrupter.

FIG. 4 illustrates how an active damping device such as that described in this document can improve operation of the vacuum circuit interrupter. In a chart in which the travel of a moveable contact's rod over time is shown, the curve modeling a hypothetical system with an active damper 401 such as that described above exhibits less bouncing, and a quicker landing speed (i.e., time to stability) as compared to a passive damper 402 such as may exist in the prior art, or a system with no damping at all 403. The damping device such as that described here also may provide normal operation of closing and opening with lower speed, to help extend system life. In addition, the damping device may be able to provide a latch function that keeps the vacuum circuit breaker in the open or closed position.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A circuit interrupter system, comprising:

a vacuum circuit interrupter that comprises a fixed contact and a moveable contact contained within a vacuum chamber;

a non-conductive rod that is connected to the moveable contact and that extends from the vacuum chamber;

an actuator that is connected to the non-conductive rod and that is configured to selectively move the non-conductive rod in a first direction that will drive the moveable contact toward the fixed contact, and in a second direction that will drive the moveable contact away from the fixed contact, wherein the actuator comprises:

a first Thomson coil that is wound around the non-conductive rod, a first armature that is connected to the non-conductive rod, and a driver that is configured to energize the first Thomson coil; and a damper that comprises a solenoid and a plunger that provides an active damping force to the non-conductive rod when the non-conductive rod is moved in the first direction, the second direction, or both the first direction and the second direction.

2. The circuit interrupter of claim 1, wherein the plunger comprises a permanent magnet.

3. The circuit interrupter system of claim 1, further comprising a solenoid actuator that is electrically connected to the solenoid and that is configured to vary damping force of the damper by varying a level of voltage or current provided to the solenoid.

4. The circuit interrupter system of claim 1, wherein:

the damper is connected to the non-conductive rod; and the actuator is positioned between the damper and the vacuum circuit interrupter.

5. The circuit interrupter system of claim 1, wherein:

the damper is connected to the non-conductive rod; and the damper is positioned between the actuator and the vacuum circuit interrupter.

6. A method of operating a vacuum circuit interrupter, the method comprising:

actuating an actuator to operate a vacuum circuit interrupter that comprises a fixed contact and a moveable contact contained within a vacuum chamber, wherein:

the actuator is connected to a non-conductive rod that is connected to the moveable contact and that extends from the vacuum chamber, the actuator comprises a first Thomson coil that is wound around the non-conductive rod, a first armature that is connected to the non-conductive rod, and a driver that is configured to energize the first Thomson coil, and the actuating comprises, by the driver, energizing the first Thomson coil so that when the first Thomson coil is energized the first armature will be repelled from the first Thomson coil and move the non-conductive rod to open the vacuum circuit interrupter; and causing a damper that is attached to the non-conductive rod to apply an active damping force to the non-conductive rod when the non-conductive rod is moved.

7. The method of claim 6, wherein:

the actuator further comprises a second Thomson coil that is wound around the non-conductive rod; and the actuating further comprises, by the driver, energizing the second Thomson coil so that when the second Thomson coil is energized, the first armature will be repelled from the second Thomson coil and move the non-conductive rod to close the vacuum circuit interrupter.

8. The method of claim 6, wherein:

the actuator further comprises a second Thomson coil that is wound around the non-conductive rod and a second armature that is connected to the non-conductive rod; and the actuating further comprises, by the driver, energizing the second Thomson coil so that when the second Thomson coil is energized the second armature will be repelled from the second Thomson coil and move the non-conductive rod to open the vacuum circuit interrupter.

9. A circuit interrupter system, comprising:

a vacuum circuit interrupter that comprises a fixed contact and a moveable contact contained within a vacuum chamber;

a non-conductive rod that is connected to the moveable contact and that extends from the vacuum chamber;

an actuator that is connected to the non-conductive rod, wherein the actuator comprises:

a first Thomson coil that is wound around the non-conductive rod, a first armature that is connected to the non-conductive rod, and a driver that is configured to energize the first Thomson coil so that when the first Thomson coil is energized, the first armature will be repelled from the first Thomson coil and will move the non-conductive rod to open the vacuum circuit interrupter; and a damper that comprises a solenoid and a permanent magnet that is configured to provide an active damping force to the non-conductive rod when the non-conductive rod is moved to open the vacuum circuit interrupter.

10. The circuit interrupter system of claim 9, wherein:

the actuator further comprises a second Thomson coil that is wound around the non-conductive rod;

the first armature is positioned between the first Thomson coil and the second Thomson coil; and the driver is also configured to selectively energize the first Thomson coil and the second Thomson coil so that when the second Thomson coil is energized, the first armature will be repelled from the second Thomson coil, and the first armature will move the non-conductive rod to close the vacuum circuit interrupter.

11. The circuit interrupter system of claim 10, wherein the damper is also configured to provide an active damping force to the non-conductive rod when the non-conductive rod is moved to close the vacuum circuit interrupter.

12. The circuit interrupter system of claim 9, wherein:

the first armature is positioned between the first Thomson coil and the vacuum circuit interrupter;

the actuator also comprises:

a second armature that is connected to the non-conductive rod, and a second Thomson coil that is positioned between the second armature and the first Thomson coil; and the driver is also configured to selectively energize the first Thomson coil and the second Thomson coil so that when the second Thomson coil is energized, the second armature will be repelled from the second Thomson coil, and the second armature will move the non-conductive rod to close the vacuum circuit interrupter.

13. The circuit interrupter system of claim 12, wherein the damper is also configured to provide an active damping force to the non-conductive rod when the non-conductive rod is moved to close the vacuum circuit interrupter.

14. The circuit interrupter system of claim 9, further comprising a solenoid actuator that is electrically connected to the solenoid and that is configured to vary damping force of the damper by varying a level of voltage or current provided to the solenoid.

15. The circuit interrupter system of claim 9, wherein:

the damper is connected to the non-conductive rod; and the actuator is positioned between the damper and the vacuum circuit interrupter.

16. The circuit interrupter system of claim 9, wherein:

the damper is connected to the non-conductive rod; and the damper is positioned between the actuator and the vacuum circuit interrupter.

17. The circuit interrupter system of claim 9, wherein the damper is connected to a second non-conductive rod that is connected to the fixed contact and that extends from the vacuum chamber.

18. A circuit interrupter system, comprising:

a vacuum circuit interrupter that comprises a fixed contact and a moveable contact contained within a vacuum chamber;

a non-conductive rod that is connected to the moveable contact and that extends from the vacuum chamber;

an actuator that is connected to the non-conductive rod and that is configured to selectively move the non-conductive rod in a first direction that will drive the moveable contact toward the fixed contact, and in a second direction that will drive the moveable contact away from the fixed contact; and a damper that comprises a solenoid and a plunger that provides an active damping force to the non-conductive rod when the non-conductive rod is moved in the first direction, the second direction, or both the first direction and the second direction;

wherein the actuator comprises:

a first Thomson coil that is wound around the non-conductive rod, a second Thomson coil that is wound around the non-conductive rod, an armature that is connected to the non-conductive rod and positioned between the first Thomson coil and the second Thomson coil, and a driver that is configured to selectively energize the first Thomson coil and the second Thomson coil so that:

when the first Thomson coil is energized, the armature will be repelled from the first Thomson coil, and the armature will move the non-conductive rod in the first direction; and when the second Thomson coil is energized, the armature will be repelled from the second Thomson coil, and the armature will move the non-conductive rod in the second direction.

19. The circuit interrupter system of claim 18, further comprising a solenoid actuator that is electrically connected to the solenoid and that is configured to vary damping force of the damper by varying a level of voltage or current provided to the solenoid.

20. The circuit interrupter system of claim 18, wherein:

the damper is connected to the non-conductive rod; and the actuator is positioned between the damper and the vacuum circuit interrupter.

21. The circuit interrupter system of claim 18, wherein:

the damper is connected to the non-conductive rod; and the damper is positioned between the actuator and the vacuum circuit interrupter.

22. The circuit interrupter of claim 18, wherein the plunger comprises a permanent magnet.

23. A circuit interrupter system, comprising:

a vacuum circuit interrupter that comprises a fixed contact and a moveable contact contained within a vacuum chamber;

a non-conductive rod that is connected to the moveable contact and that extends from the vacuum chamber;

an actuator that is connected to the non-conductive rod and that is configured to selectively move the non-conductive rod in a first direction that will drive the moveable contact toward the fixed contact, and in a second direction that will drive the moveable contact away from the fixed contact; and a damper that comprises a solenoid and a plunger that provides an active damping force to the non-conductive rod when the non-conductive rod is moved in the first direction, the second direction, or both the first direction and the second direction wherein the actuator comprises:

a first Thomson coil that is wound around the non-conductive rod, a second Thomson coil that is wound around the non-conductive rod, a first armature that is connected to the non-conductive rod and positioned between the first Thomson coil and the vacuum circuit interrupter, a second armature that is connected to the non-conductive rod and positioned so that the second Thomson coil is between the vacuum circuit interrupter and the second armature, and a driver that is configured to selectively energize the first Thomson coil and the second Thomson coil so that:

when the first Thomson coil is energized, the first armature will be repelled from the first Thomson coil, and the first armature will move the non-conductive rod to close the vacuum circuit interrupter; and when the second Thomson coil is energized, the second armature will be repelled from the second Thomson coil, and the second armature will move the non-conductive rod in the second direction to open the vacuum circuit interrupter.

24. The circuit interrupter of claim 23, wherein the plunger comprises a permanent magnet.

25. The circuit interrupter system of claim 23, further comprising a solenoid actuator that is electrically connected to the solenoid and that is configured to vary damping force of the damper by varying a level of voltage or current provided to the solenoid.

* * * * *